US012465182B2

(12) United States Patent
Cousar et al.

(10) Patent No.: US 12,465,182 B2
(45) Date of Patent: Nov. 11, 2025

(54) TRAVELERS SEAT

(71) Applicants: Sterling Cousar, Fairdield, AL (US); Collin Cousar, Fairfield, AL (US); Stephanie Cousar, Fairfield, AL (US)

(72) Inventors: Sterling Cousar, Fairdield, AL (US); Collin Cousar, Fairfield, AL (US); Stephanie Cousar, Fairfield, AL (US)

( * ) Notice: Subject to any disclaimer, the term of this patent is extended or adjusted under 35 U.S.C. 154(b) by 0 days.

(21) Appl. No.: 18/631,820

(22) Filed: Apr. 10, 2024

(65) Prior Publication Data

US 2025/0318698 A1 Oct. 16, 2025

(51) Int. Cl.
*A47K 13/00* (2006.01)

(52) U.S. Cl.
CPC ..... *A47K 13/005* (2013.01)

(58) Field of Classification Search
CPC ..... A47K 13/005; A47K 13/02; A47K 13/04; A47K 13/06; A47K 13/14; A47K 13/18; A47K 13/16
USPC ..... 4/239, 245.1, 245.3, 245.4, 245.6–245.8, 4/244.3
See application file for complete search history.

(56) References Cited

U.S. PATENT DOCUMENTS 5,090,063 A * 2/1992 Edwards ..... A47K 13/14 4/245.7
6,000,068 A * 12/1999 Chavis ..... A47K 13/005 4/244.3
6,058,518 A * 5/2000 Akazawa ..... A47K 13/16 4/245.4
6,073,274 A * 6/2000 McQueen ..... A47K 13/16 4/245.7
6,385,783 B1 * 5/2002 Eliason ..... A47K 13/24 4/245.3
7,247,360 B1 * 7/2007 Besner ..... A47K 13/16 4/245.7
2008/0263757 A1 * 10/2008 Samuels ..... A47K 13/14 4/239
2012/0017361 A1 * 1/2012 Lankenau ..... A47K 13/16 4/244.3

* cited by examiner

*Primary Examiner* — Tuan N Nguyen
(74) *Attorney, Agent, or Firm* — William J. Benman; Benman, Brown & Williams

(57) ABSTRACT

A travelers seat comprising a unitary portable toilet seat having an upper surface for supporting a user and an underside for engaging a toilet bowl and adhesive for securing at least one of a plurality of individually removable seat covers secured to the underside of the toilet seat. In alternative embodiments, the inventive seat further includes a plurality of individually removable toilet seat or toilet bowl covers secured to the underside of the travelers seat via an adhesive. The inventive seat may be foldable and/or filled with a gel. In another embodiment, the inventive seat further includes an adhesive under the tissue to secure the tissue to a toilet seat or toilet bowl whereby, upon removal, it stays on the toilet seat or bowl. In yet another embodiment, the portable seat is equipped with a rigid removable wall to allow for the use of the seat as a stadium seat.

4 Claims, 7 Drawing Sheets top perspective view bottom perspective view bottom perspective view exploded perspective kit view cross section where we incorporate a living hinge FIG. 10
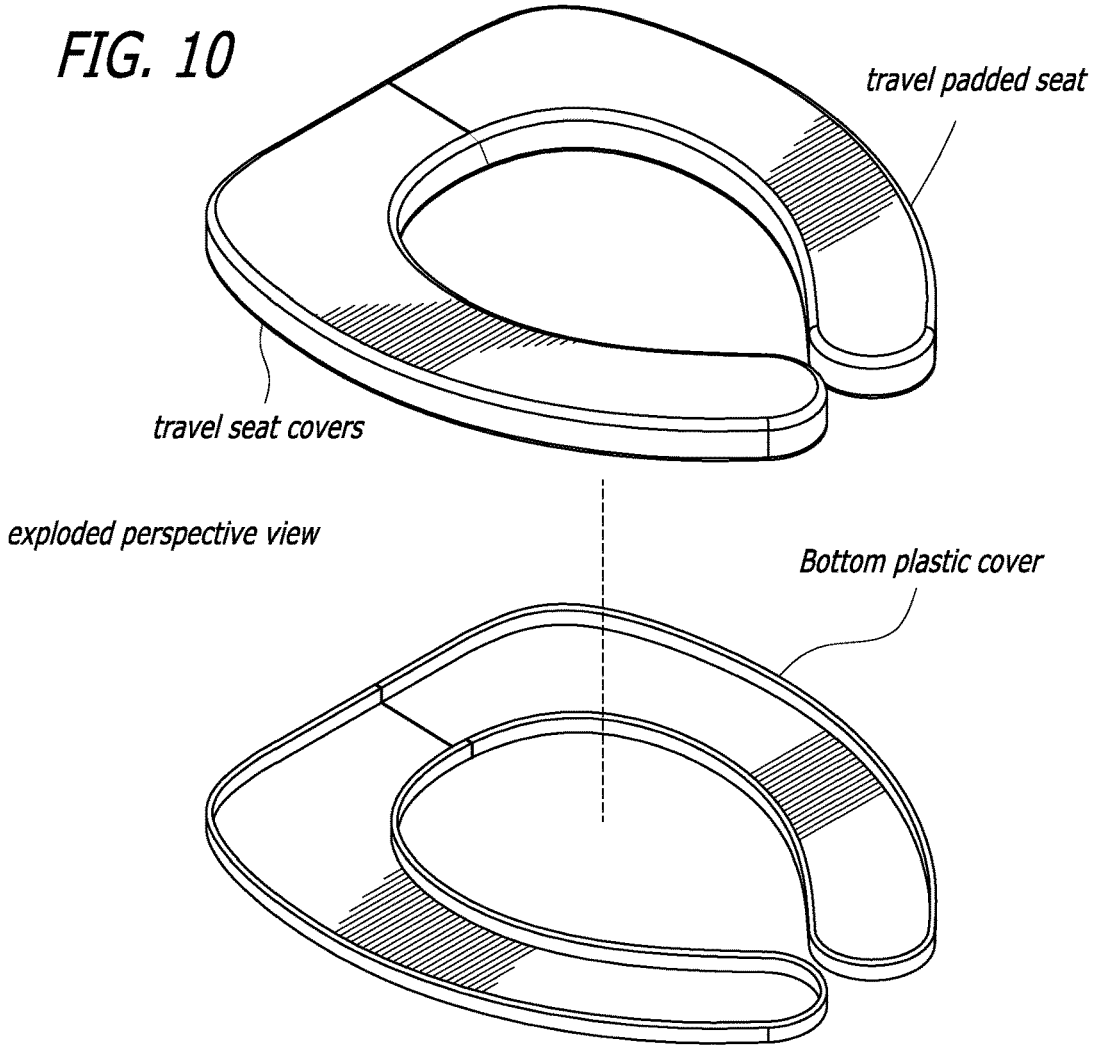
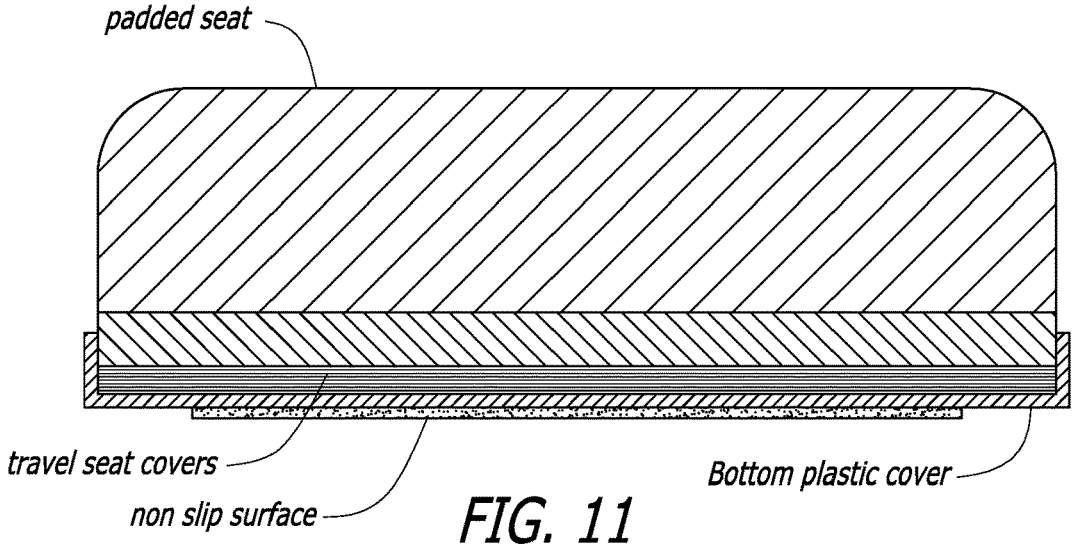
FIG. 11

TRAVELERS SEAT

BACKGROUND OF THE INVENTION

Field of the Invention

The present invention relates to toilets. More specifically, the present invention relates to toilet seats.

Description of the Related Art

A toilet seat is a hinged unit consisting of a round or oval open seat, typically with a lid which is bolted onto a bowl of a toilet. The toilet is typically used in a seated position. A toilet seat consists of the seat itself, which may be contoured for the user to sit on, and the lid, which covers the toilet when it is not in use—the lid may be absent in some cases, particularly in public restrooms. See 'Toilet Seats' on Wikipedia, As noted in the article, toilet seats are manufactured in a range of different styles and colors, and they may be furnished matching the style of the toilet itself. They are usually built to fit the shape of the toilet bowl: two examples of this being the elongated bowl and the regular bowl. Some toilet seats are fitted with slow-closing hinges to reduce noise by preventing them from slamming against the bowl.

Some seats are made of various types of wooden materials, like oak or walnut, and others are made soft for added comfort. Other designs are made of transparent plastic.

Toilet seats often have a lid. This lid is frequently left open. The combined toilet seat and lid is often kept in a closed position when a toilet is not in use, requiring the lid to be raised prior to use. Closure prevents small items from falling in, reduces odors, and provides a chair in the toilet room for aesthetic purposes.

Toilet seats typically rest on a porcelain or metal body of the toilet but often rest not directly on the porcelain or metal body of the toilet itself but upon the hinges and upon tabs/spacers affixed at a few spots. Similarly, lids do not rest directly in uniform contact with the seat but are elevated while above it by the hinges and tabs/spacers affixed at a few spots. This is a possible area where effluent aerosols can be spread when shut.

Unfortunately, in public restrooms in typical U.S. restaurants, truck stops, port-a-potties, or any public venue, the toilet seats are seldom installed with lids. Accordingly, there is a risk of bacteria on the seat due to effluent aerosols. Often, this risk is mitigated by the use of dispensable tissues which can be placed on the seat of the toilet prior to use. However, this requires a user to handle either fresh tissue from an often empty box located on a wall somewhere or, worse yet, handle an unsanitary tissue by hand left on the bowl.

Accordingly, there is a need in the art for a more sanitary alternative to conventional public toilet seats. This need is currently addressed in part by portable toilet seats. Unfortunately, conventional portable toilet seats require handling after the seat is utilized on the conventional, typically unsanitary, toilet bowl.

Hence, a need remains in the art for a more sanitary alternative to conventional portable toilet seats.

SUMMARY OF THE INVENTION

The need in the art is addressed by the travelers seat of the present invention. In the illustrative embodiment, the travelers seat comprises a unitary portable toilet seat having an upper surface for supporting a user, an underside for engaging a toilet bowl and means for securing at least one of a plurality of individually removable seat covers secured to the underside of the toilet seat, as opposed to a top thereof as per conventional teachings.

In alternative embodiments, the inventive seat further includes a plurality of individually removable toilet seat or toilet bowl covers secured to the underside of the travelers seat via an adhesive. The inventive seat may be foldable and/or filled with a gel.

In another embodiment, the inventive seat further includes an adhesive under the tissue to secure the tissue to a toilet seat or toilet bowl whereby, upon removal, it stays on the toilet seat or bowl. In yet another embodiment, the portable seat is equipped with a rigid removable wall to allow for the use of the seat as a stadium seat.

Also disclosed herein is a unique bag designed to retain, disinfect and otherwise clean the seat when the seat is stored therein.

BRIEF DESCRIPTION OF THE DRAWINGS

FIG. 10 shows an exploded perspective view by which the foldable travelers seat of FIG. 7, along with its associated travel seat tissues, are positioned to snap into an optional thin plastic hinged bottom for protection and use as a stadium seat in an alternative application in accordance with the present teachings.

FIG. 11 is a sectional view of the alternative folded embodiment of the travelers seat depicted in FIG. 10 along a line therethrough (not shown), such as that taken along line 3-3, fully inserted and snapped into the plastic cover shown in FIG. 10 in accordance with the present teachings.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

As noted above, the need in the art for a more sanitary alternative to conventional public toilet seats is addressed by the travelers seat of the present invention. In accordance with the present teachings, a portable toilet seat is envisioned with an arrangement for retaining a stack of removable, disposable tissues on the bottom surface thereof. The inventive toilet is designed and constructed to sit on a public toilet bowl or seat if it has one. The placement of the tissue on the underside of the inventive travelers seat allows for the user to be protected from bacteria that might reside on the toilet bowl or seat. Further, the user need not handle any tissues on the public toilet seat as it common in the art. Thus, the invention enables a user to have a clean, sanitary experience on his or her personal toilet seat with enhanced peace of mind.

Figure 1:
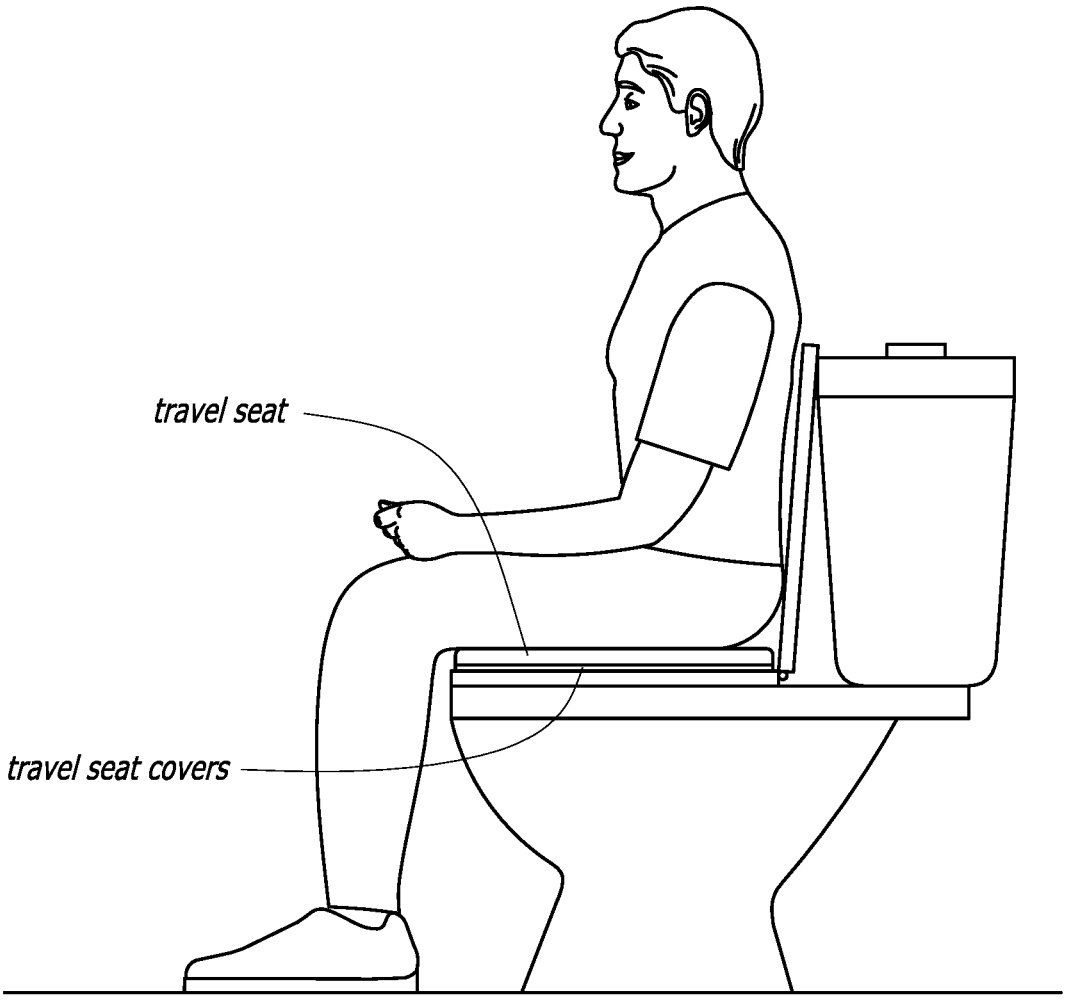
FIG. 1 is a side view of an illustrative embodiment of the travelers seat of the present invention in practice.

FIG. 1 is a side view of an illustrative embodiment of the travelers seat of the present invention in practice.

Figure 2:
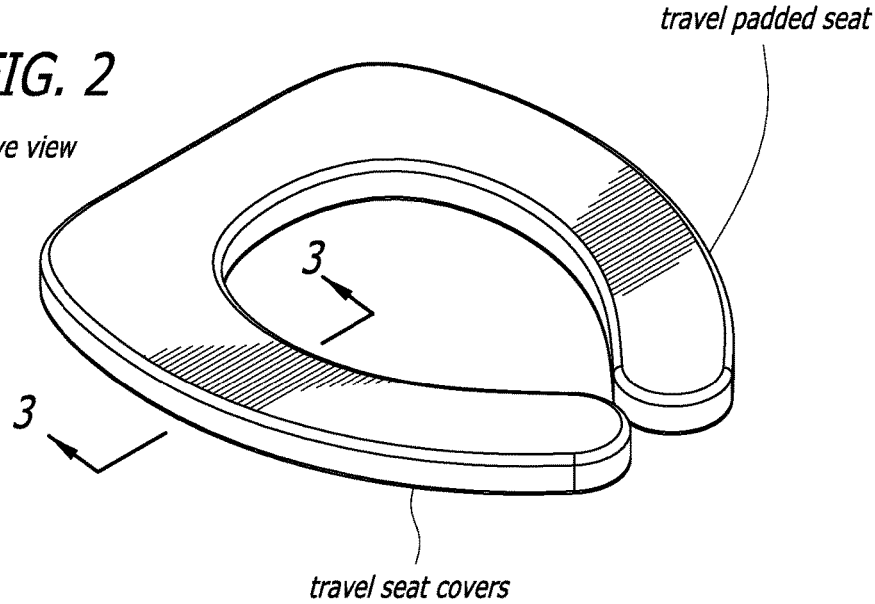
FIG. 2 is perspective top view of the travelers seat of depicted in FIG. 1.

FIG. 2 is perspective top view of the travelers seat of depicted in FIG. 1.

As shown in FIGS. 1 and 2, in the illustrative embodiment, the inventive travelers seat comprises a unitary portable toilet seat having an optionally padded upper surface for supporting a user and an underside for engaging a toilet bowl.

Figure 3:
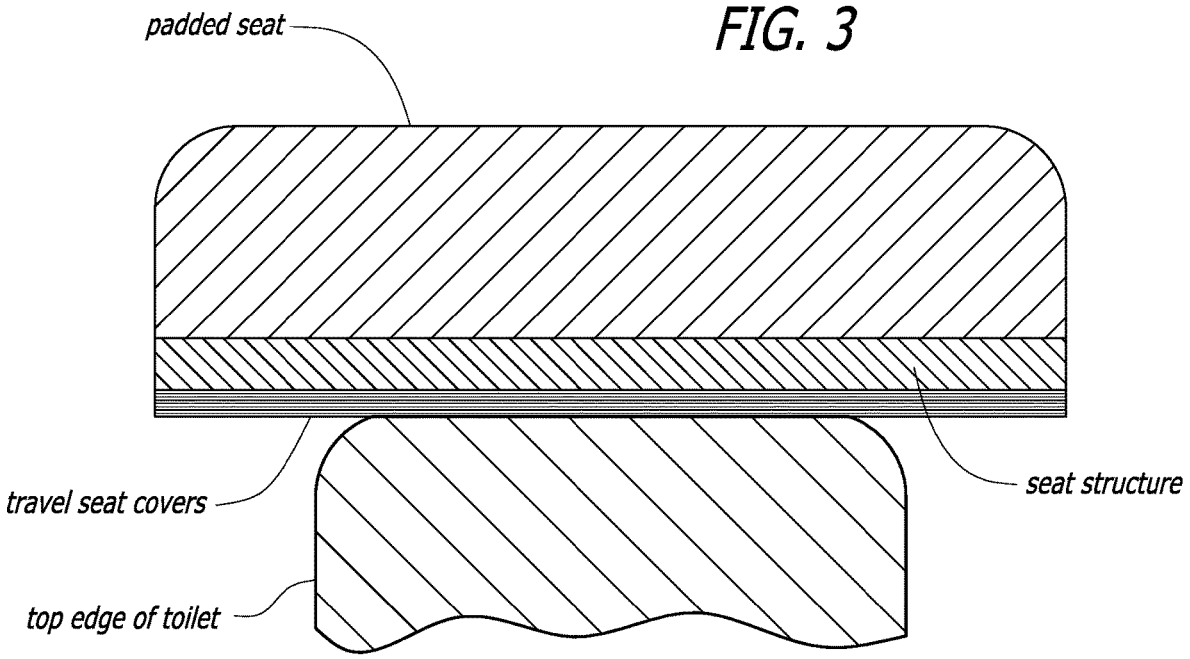
FIG. 3 is a sectional view of the travelers seat depicted in FIG. 2 along the line 3-3 of thereof.

FIG. 3 is a sectional view of the travelers seat depicted in FIG. 2 along the line 3-3 of thereof.

The portable toilet seat can be of any size and shape. In the best mode, the travelers seat of the present invention is shaped to sit on top of a public toilet seat or directly on the toilet bowl if no toilet seat is provided.

As will be appreciated by those of ordinary skill in the art, the portable toilet seat of the present invention may be made of plastic, wood, metal, polymer or other material per the requirements of a customer.

In a typical application, the portable toilet seat would optimally have a length ranging from 40.5 to 45.7 centimeters, a width ranging from 35.5 to 38 centimeters and a thickness ranging from 2.5 to 4 centimeters. However, the present invention is not limited to the construction or dimensions of the seat. Those of ordinary skill in the art can be expected to make the portable seat of the present invention with any material, in any size and with any shape that might be seen as optimal for a given application.

Figure 4:
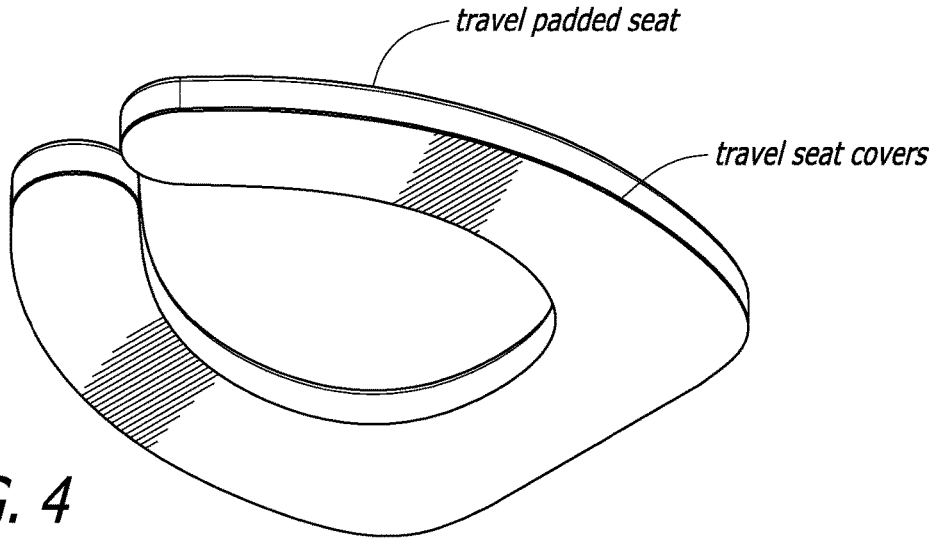
FIG. 4 is a perspective bottom view of the travelers seat of FIG. 1.

FIG. 4 is a perspective bottom view of the travelers seat of FIG. 1.

Figure 5:
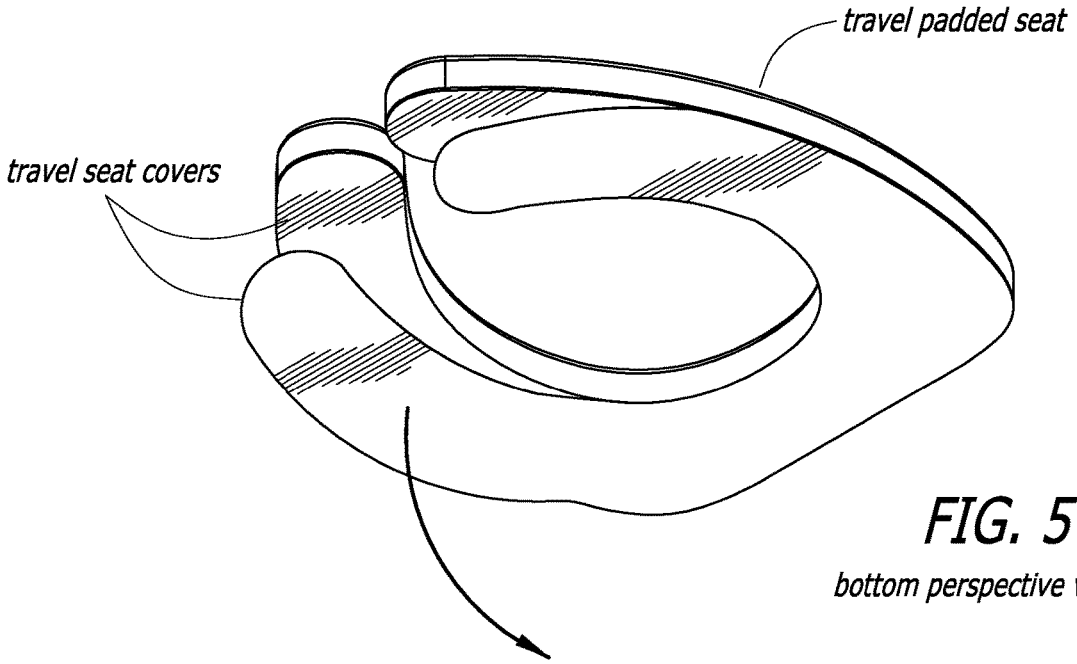
FIG. 5 is the perspective bottom view of the travelers seat depicted in FIG. 4 with one of the inventive tissues on the underside thereof partially removed in accordance with the present teachings.

FIG. 5 is the perspective bottom view of the travelers seat depicted in FIG. 4 with one of the inventive tissues on the underside thereof partially removed in accordance with the present teachings.

As best illustrated in FIGS. 3-5, in accordance with the present teachings, a plurality of individually removable toilet seat or toilet bowl covers are secured to the underside of the toilet seat—as opposed to being loosely, and individually, placed on top of the toilet seat as per conventional teachings.

In the best mode, the individually removable seat covers are individual sheets of paper tissue. The sheets may be made of paper, wax or other suitable material.

Ideally the sheets are secured to each other, in a stack, via small sections of low-tack pressure-sensitive adhesive or glue that allows the notes to be easily attached, removed and even re-posted elsewhere without leaving residue as is common with conventional Post-It® type sticky notes such as those patented and sold by 3M.

In an alternative embodiment, the inventive seat may be foldable using a hinge and/or a gel construction. This is illustrated in FIG. 6.

Figure 6:
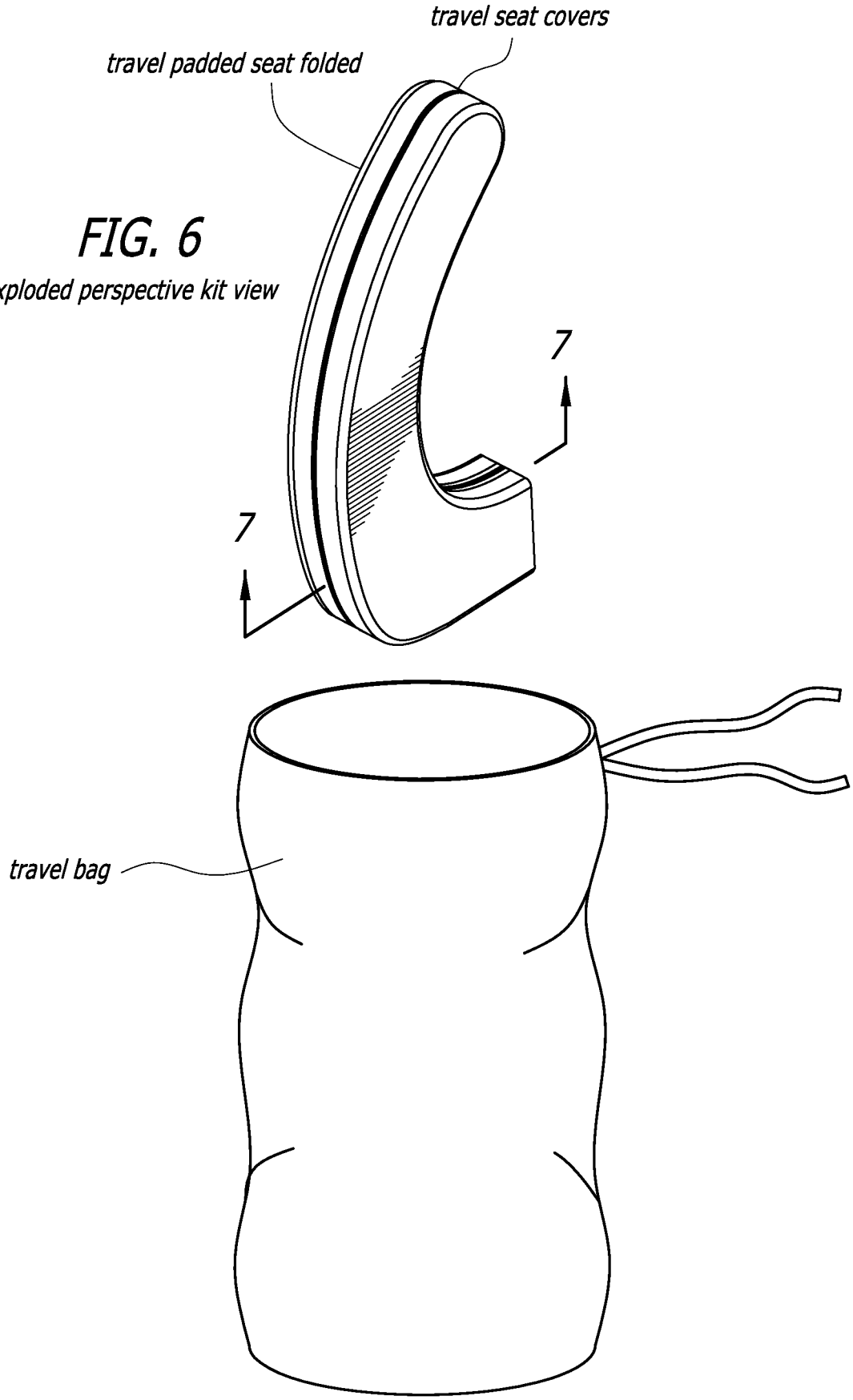
FIG. 6 is an exploded perspective kit view of a first alternative embodiment of the inventive travelers seat designed and constructed to be folded, when not in use, for ready insertion into an associated travel bag in accordance with the present teachings.

FIG. 6 is an exploded perspective kit view of a first alternative embodiment of the inventive travelers seat designed and constructed to be folded, when not in use, for ready insertion into an associated travel bag in accordance with the present teachings. Folding of the seat is effectuated via a hinge as shown in FIG. 7 or a living hinge as illustrated in FIG. 8.

Figure 7:
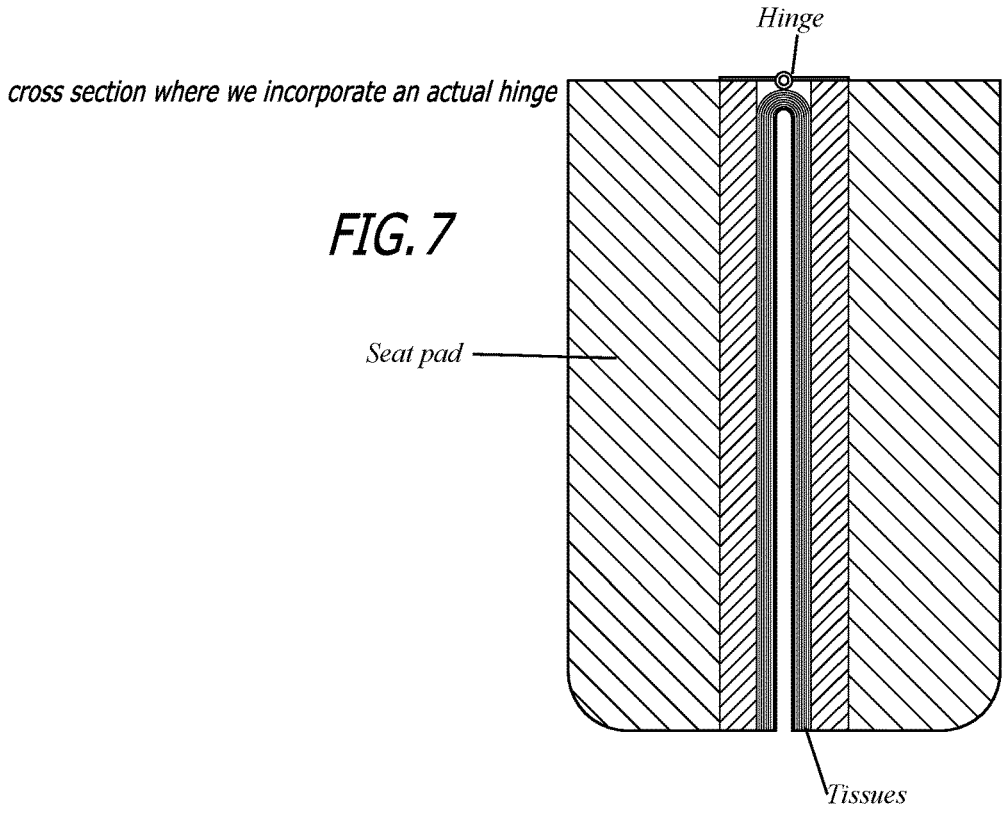
FIG. 7 is a sectional side view of the alternative embodiment depicted in FIG. 6 along the line 7-7 thereof with a hinge in accordance with a first alternative sub-embodiment of the travelers seat of the present invention.

FIG. 7 is a sectional side view of the alternative embodiment depicted in FIG. 6 along the line 7-7 thereof with a hinge in accordance with a first alternative sub-embodiment of the travelers seat of the present invention. FIG. 7 shows the structure of the seat along with an optional seat pad on the upper (outer) surface thereof. A stack of tissues is mounted under the seat structure or frame as discussed above. As noted above, the tissues are secured to the seat structure with an adhesive (not shown).

Figure 8:
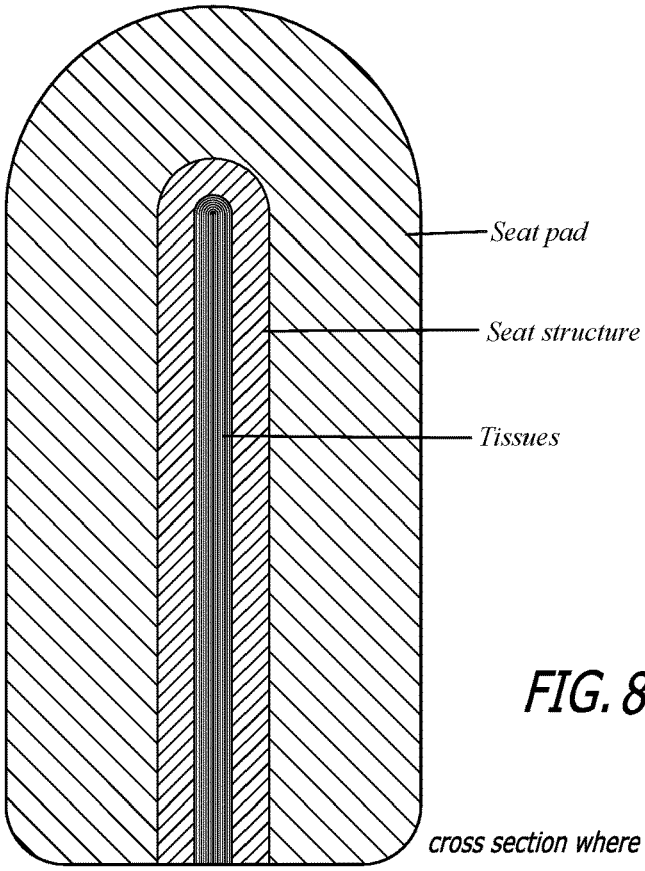
FIG. 8 is sectional side view of the alternative embodiment depicted in FIG. 7 with a living hinge, instead of an actual hinge, in accordance with a second alternative sub-embodiment of the travelers seat of the present invention.

FIG. 8 is sectional side view of the alternative embodiment depicted in FIG. 6 along the line 7-7 thereof with a living hinge, instead of an actual hinge, in accordance with a second alternative sub-embodiment of the travelers seat of the present invention. In the embodiment of FIG. 8, the padding should be flexible if not implemented with a gelatinous material.

Returning to FIG. 6, the travelers seat is folded for easy insertion into a specially designed bag as discussed above. In the best mode, the bag is built with a secondary, an inner pocket (not shown) within which the travelers seat is stored when not in use. This allows for the storage of other items in the bag with separation and isolation from the travelers seat.

Ideally, the dedicated pocket is lined, on the inside thereof, with a material adapted to store and release a cleaning agent such that with each insertion and removal, the surface of the travelers seat of the present invention is scrubbed and cleaned. For this purpose, the cleaning cloth or tissue inside the dedicated pocket in the bag may be removable and replaceable.

In another embodiment, the inventive seat further includes an adhesive under the tissue to secure the tissue to a toilet seat or toilet bowl whereby, upon removal, it stays on the toilet seat or bowl. In yet another embodiment, the portable seat is equipped with a rigid removable wall to allow for the use of the seat as a stadium seat.

Also disclosed herein is a unique bag designed to retain, disinfect and otherwise clean the seat when the seat is stored therein.

Figure 9:
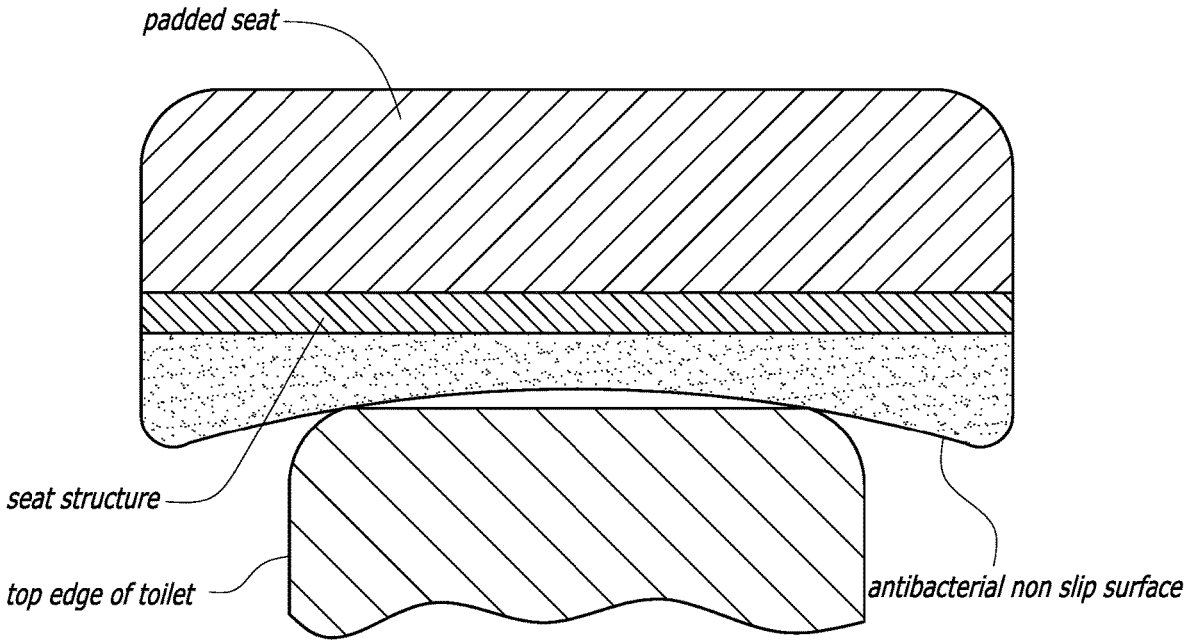
FIG. 9 is a sectional view of an alternative embodiment of the travelers seat depicted in FIG. 3 with an antibacterial non-slip surface on the underside thereof.

FIG. 9 is a sectional view of an alternative embodiment of the travelers seat depicted in FIG. 3 with an antibacterial non-slip surface on the underside thereof. This embodiment features a more secure non-slip grip for use of the travelers seat directly on the toilet bowl as opposed to a toilet seat as depicted in FIG. 1.

FIG. 10 shows an exploded perspective view by which the foldable travelers seat of FIG. 7, along with its associated travel seat tissues, are positioned to snap into an optional thin plastic hinged bottom for 1) protection and 2) use as a stadium seat in an alternative application in accordance with the present teachings.

FIG. 11 is a sectional view of the alternative folded embodiment of the travelers seat depicted in FIG. 10 along a line therethrough (not shown), such as that taken along line 3-3 in FIG. 2, fully inserted and snapped into the plastic cover shown in FIG. 10 in accordance with the present teachings. It should be noted that the bottom plastic cover could be made with metal, wood or other suitable material without departing from the scope of the present teachings. As shown in FIG. 11, a non-slip surface of rubber, polymer, or other suitable material may be added to the bottom plastic cover.

Those having ordinary skill in the art and access to the present teachings will recognize additional modifications, applications and embodiments within the scope thereof. For example, the travelers seat of the present invention may be implemented with a 'handsfree tear-away' feature with tissues having an adhesive on the underside thereof effective to allow the tissue to be torn from the seat hands-free upon removal of the seat from the toilet seat or toilet bowl. Those of ordinary skill in the art that this embodiment would require an adhesive on the upper side of the tissue that pulls a protective non-adhesive layer of wax or other suitable material from the stack to activate the next sheet of tissue for use without pulling the entire stack from the seat.

It is therefore intended by the appended claims to cover any and all such applications, modifications and embodiments within the scope of the present invention.

The invention claimed is:

1. A travelers seat consisting of:

a unitary portable seat having an upper surface for supporting a user and an underside for engaging a toilet seat or bowl;

a stack of individually removable tissues secured to the underside of the portable seat and adhesive for securing said individually removable tissue to the underside of the portable seat.

2. The invention of claim 1 wherein said travelers seat is u-shaped.

3. The invention of claim 1 wherein said travelers seat is foldable.

4. The invention of claim 1 wherein the travelers seat is designed to serve a dual purpose as a stadium seat.

* * * * *